US007140320B2

(12) United States Patent
Bamert

(10) Patent No.: US 7,140,320 B2
(45) Date of Patent: Nov. 28, 2006

(54) DEVICE FOR HOLDING THE LOG TRANSMITTER OF A BOAT SPEEDOMETER

(76) Inventor: Hans Joachim Bamert, Lerchenstrasse 49, D-90425 Nürnberg (DE)

( * ) Notice: Subject to any disclaimer, the term of this patent is extended or adjusted under 35 U.S.C. 154(b) by 894 days.

(21) Appl. No.: 09/856,390

(22) Filed: May 22, 2001

(65) Prior Publication Data

US 2003/0131778 A1 Jul. 17, 2003

(51) Int. Cl.
*B63B 17/00* (2006.01)

(52) U.S. Cl. ..... 114/343; 73/187

(58) Field of Classification Search ..... 114/198, 114/343; 73/181, 182, 183, 187
See application file for complete search history.

(56) References Cited

U.S. PATENT DOCUMENTS

| | | | | | |
|---|---|---|---|---|---|
| 25,094 | A | * | 8/1859 | Clear | 114/198 |
| 88,008 | A | * | 3/1869 | Chase | 251/301 |
| 988,832 | A | * | 4/1911 | Star | 73/187 |
| 1,714,205 | A | * | 5/1929 | Baule | 73/187 |
| 1,765,039 | A | * | 6/1930 | Walker | 73/187 |
| 1,903,713 | A | * | 4/1933 | Baule | 73/183 |
| 1,989,332 | A | * | 1/1935 | Munster et al. | 73/187 |
| 2,136,756 | A | * | 11/1938 | Rockall et al. | 73/187 |
| 2,362,298 | A | * | 11/1944 | Newell | 73/182 |
| 3,400,582 | A | * | 9/1968 | Warner | 73/181 |
| 3,496,770 | A | * | 2/1970 | Fassett | 73/187 |
| 3,596,513 | A | * | 8/1971 | Sandstedt | 73/181 |
| 3,874,317 | A | * | 4/1975 | Hikita | 114/198 |
| 3,903,741 | A | * | 9/1975 | Greene | 73/181 |
| 4,836,020 | A | * | 6/1989 | Boucher | 73/187 |
| 4,914,945 | A | * | 4/1990 | Nakamura et al. | 73/182 |
| 5,186,050 | A | | 2/1993 | Lagace et al. | |
| 5,581,025 | A | * | 12/1996 | Boucher et al. | 73/187 |

FOREIGN PATENT DOCUMENTS

| | | |
|---|---|---|
| DE | 41 31 561 | 4/1993 |

* cited by examiner

*Primary Examiner*—Lars A. Olson
(74) *Attorney, Agent, or Firm*—Collard & Roe, P.C.

(57) ABSTRACT

A device for holding a boat speedometer log transmitter in a boat hull has a sleeve body fixed in a perforation in the hull with a longitudinal center opening for removably inserting and retaining the log transmitter in a watertight manner. A head part is coupled to the longitudinal opening for jointly receiving the log transmitter in a watertight manner. An axially displaceable sliding ring is located in a coaxial recess in the head part. A plane ring body supporting a sealing ring is located below the sliding ring. The sliding ring and sealing ring define a plane for guiding a transversely movable blocking slide which blocks and opens the openings for removal and insertion of the log transmitter.

13 Claims, 3 Drawing Sheets

9
15
14

12'''
12''
10
9
14'
14
16
15'
15''
15

18
17
22
19
20

22
18
15''
15
20
19
17

15''
15
15'

9'
27

21

28
30

DEVICE FOR HOLDING THE LOG TRANSMITTER OF A BOAT SPEEDOMETER

CROSS REFERENCE TO RELATED APPLICATIONS

Applicant claims priority under 35 U.S.C. §119 of GERMAN Application No. 199 50 751.1 filed on Oct. 21, 1999. Applicant also claims priority under 35 U.S.C. §§120 and 365(c) of PCT/EP00/10189 filed on Oct. 17, 2000. The international application under PCT article 21(2) was not published in English.

BACKGROUND OF THE INVENTION

1. Field of the Invention

The invention relates to a device for holding the log transmitter of a boat speedometer, comprising a sleeve body with a longitudinal center opening arranged in a fixed manner in a perforation in the hull of the boat. The log transmitter, which is equipped with a fan wheel or the like, can be inserted in and retained in said perforation in a watertight and detachable manner.

2. Prior Art

In conjunction with a known system for measuring the speed of boats, use is made of a log transmitter that is accommodated in a sleeve body that is fixed on the boat. Said log transmitter comprises a rotating fan wheel that can be influenced by the water for generating measuring pulses that are supplied to an indicator element via electrical conductors. Furthermore, it is known that substances suspended and floating in the water in many cases influence or obstruct the motion of the fan wheel particularly after the boat has been moored for longer periods of time, so that cleaning or repair work is required. The log transmitter has to be removed from the sleeve body for such work, whereby larger amounts of water flow via the center opening into the interior of the boat while the log transmitter is being removed, and in the course of the subsequent reinstallation of the latter. Such water often can be removed only in a complicated manner.

SUMMARY OF THE INVENTION

The problem of the invention is to provide measures that prevent water from entering the interior of the boat as the log transmitter is being removed or installed or replaced.

Said problem is solved according to the invention in that the sleeve body, on which the end facing away from the water supports a head part in a watertight manner, said head part having a coaxial center opening that is connected with the longitudinal center opening of the sleeve body in a watertight manner and having the same shape and cross sectional size as the latter opining; that the longitudinal and center openings jointly receive the log transmitter in a watertight manner; and in that the longitudinal and center openings can be blocked or released by a blocking slide depending on the position of the log transmitter, said slide being transversely guided in a watertight manner in the head part. In this way, when the log transmitter is removed and has reached a position located above the plane of the blocking slide, the latter can be pushed into the closing position for the center openings or, when the log transmitter is subsequently inserted again and has nearly reached of the plane of the slide, the blocking slide has to be moved outwards in order to release the center openings, so that the log transmitter can be moved into the working position.

Over the short duration of the movements for removing or reinserting the log transmitter, the blocking slide prevents amounts of water during said process from flowing into the interior of the boat via the longitudinal and center openings.

In designing the device, provision is made that the head part is directly connected with the sleeve body in a fixed, but detachable manner, or by means of a threaded ring that is provided in a fixed manner on the head part. Furthermore, provision is made that the head part has a sliding ring that is accommodated in a watertight manner with axial play against spring force in a recess disposed coaxially with the center opening, whereby said sliding ring and a plane ring body supporting another sealing ring and being held on the head part by the threaded ring jointly define the plane of the blocking slide and the top and bottom sides. The sliding ring is preferably supported in a watertight manner on a sealing ring, for example on an O-ring made of a springy, elastic material, which is arranged in the recess and delivers the spring force. Due to tensions in the sealing ring, said sealing O-ring can be displaced and held in the direction of the ring body and lifted from said position by a component acting on the sliding ring transversely in relation to the direction of movement of the blocking slide, in order to release the plane of the blocking slide. By means of the sealing ring acting on the sliding ring and the sealing ring arranged in the ring body, the blocking slide can be guided in a watertight manner in the head part in or on both sides, and water is prevented from passing by in the direction of the end of the log transmitter facing away from the fan wheel. The annular body is usefully made of any desired, for example metallic or plastic material, and provided with a groove located in the zone of the plane of the blocking slide for receiving a further sealing ring.

Furthermore, provision is made that the ring body permanently stabilizes the plane of the blocking slide vertically by means of elevations provided on the ring body, such elevations being supported on the bottom side of the head part, and is forming by such elevations additional lateral guide surfaces for guiding the blocking slide. According to a preferred embodiment, provision is made that with its bottom side, the sliding ring slightly projects under the head part, which safely assures that the sliding ring and the blocking slide can come into contact with one another for processes that seal the blocking slide.

It is possible to form the ring acting on the sliding ring in an elastic manner from any desired suitable material, preferably from a springy-elastic plastic material, for example from a foamed plastic. Rings of said type are useful if the depths of immersion of the hull of the boat are low, whereas greater depths of immersion of the hull of the boat require spring forces and sealing by means of metallic bodies, for example in the form of coil springs.

Furthermore, provision is made that in the head part, near its upper end within the zone of the center opening, a ring-shaped sealing body, in particular an O-ring is arranged in a groove enlarged by a radial widening. In the operating position, said ring rests against the log transmitter in a pressure-applying, sealing manner, and, when the log transmitter is removed from the longitudinal and center openings, first defines as a stop means for O-rings additionally arranged on the log transmitter the outer end position of the log transmitter in the head part as a type of pressure point; and, when the log transmitter is subsequently displaced further, permits complete removal of the logger by means of a pressing force than can be induced into the widening of the groove by means of one of the O-rings.

In further development of the device, provision is made that the log transmitter is connected with the head part by an axial control cam, for example in the form of a cover having a screw thread, and fixed by means of the cover in the longitudinal and center openings of the sleeve body and the head part. The log transmitter can be removed and installed in the device by unscrewing and removing the cover.

An alternative embodiment of the device for solving the problem according to the invention is proposed according to a further invention by the measures disclosed. In said embodiment of the invention, the blocking slide displaceable into or from the blocking position is replaced by a pivot-mounted blocking element. Embodiments of the modified device are also disclosed.

BRIEF DESCRIPTION OF THE DRAWINGS

The invention is explained in the following with the help of an exemplified embodiment shown in the drawing, in which.

DETAILED DESCRIPTON OF THE INVENTION

Figure 1:
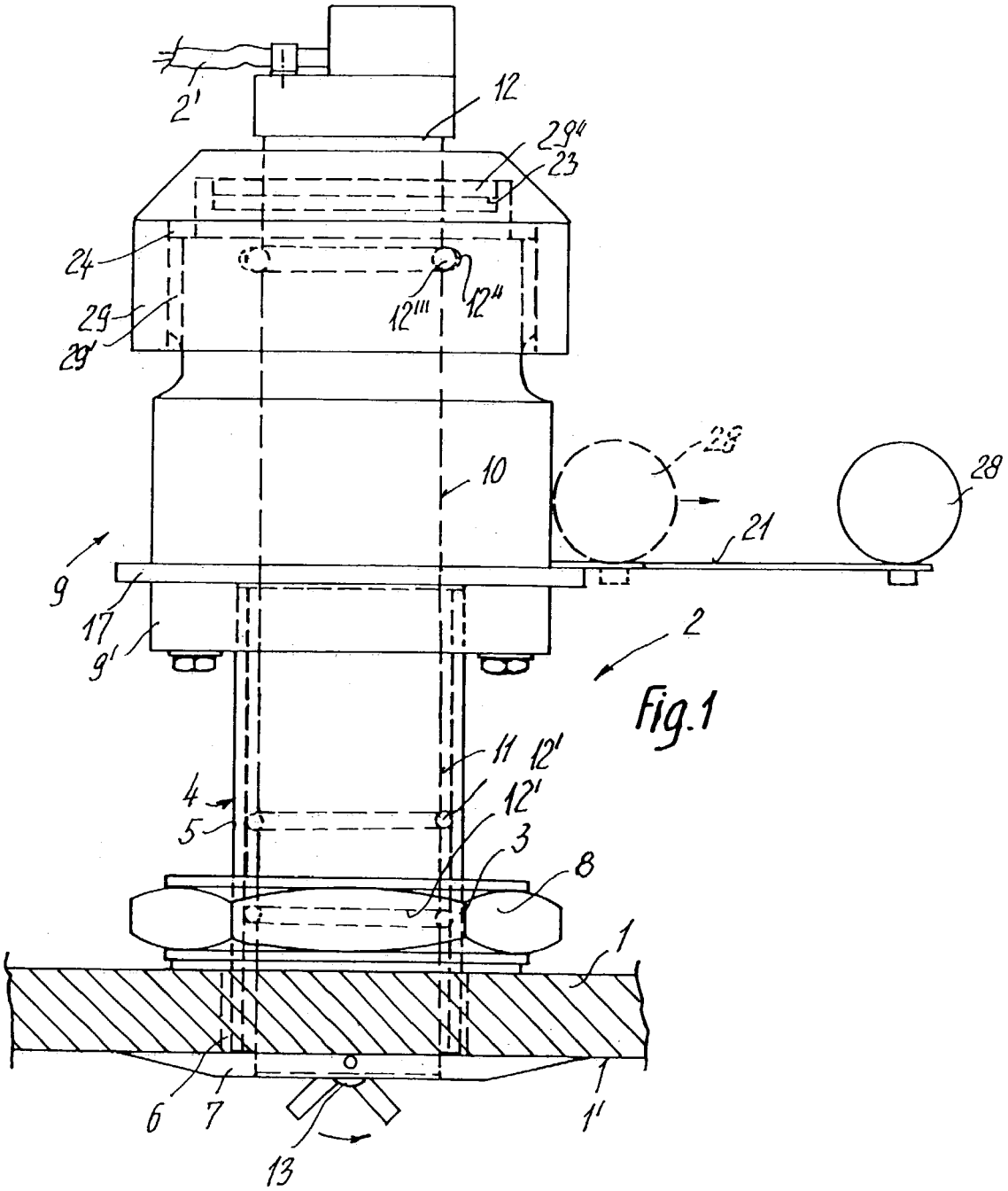
FIG. 1 shows a side view of a device.
Figures 2, 3, 4, 5, 6, 7, 8, 9, 10:
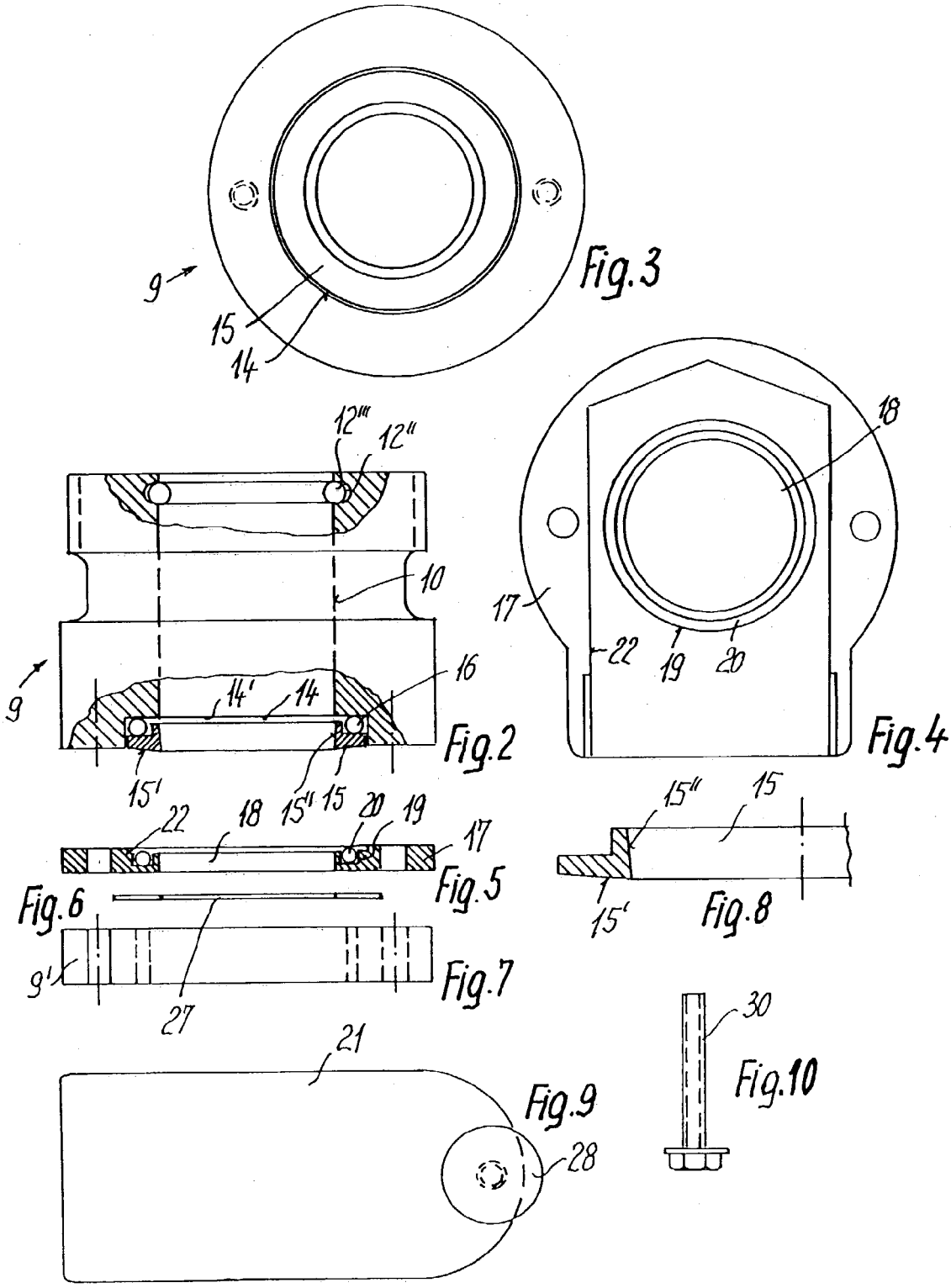
FIG. 2 is a sectional side view of a part component of a head part.
FIG. 3 is a bottom view of the part component according to FIG. 2.
FIG. 4 is a top view of a metallic ring body.
FIG. 5 is a sectional view of a ring body according to FIG. 4.
FIG. 6 is a side view of a ring-shaped seal.
FIG. 7 is a side view of a threaded ring for the head part.
FIG. 8 shows an enlarged partial section through a sliding ring.
FIG. 9 is a top view of a blocking slide.
FIG. 10 is a side view of a connecting screw.

FIG. 1 show a part piece 1 of the wall of the hull of a boat, on which the device 2 is fixed by a screw fastening 3. The device has a sleeve body 4 with the outer thread 5, which extends through an opening 6 in the wall 1 of the hull of the boat in the direction of the interior of the boat. By means of a flange 7, said sleeve body is supported on the bottom side 1' of the wall 1 of the hull of the boat, and fixed by a threaded nut 8. A head part 9 is connected with the sleeve body 4 in a fixed manner via a threaded ring 9'. The head part 9 has a cylindrical center opening 10 that extends coaxially with a longitudinal center opening 11 of the sleeve body 4. The center opening 10 and the longitudinal opening 11 jointly serve for receiving a log transmitter 12, which is inserted in the openings 10, 11 with the use of the O-rings 12' in a watertight manner. On its end facing away from the head part 9, the log transmitter 12 has a rotationally movable fan wheel 13 serving as the pulse transmitter for speed measurements. The log transmitter 12 is connected with an indicator device (not shown) via a cable 2'. Furthermore, the head part 9 is provided with a recess 14 (FIG. 2), which is coaxial with the center opening 10. A sliding ring 15 (FIG. 8) is guided in said recess 14 with axial play. Said sliding ring is subjected to the action of a spring force, for example the spring force exerted by a sealing ring 16 made of plastic. The sliding ring 15 rests on the sealing ring 16, which is supported on the bottom 14' of the recess 14, and is displaceable by said sealing ring 16 in the direction of the lower end of the head part 9. Furthermore, the head part 9 is provided with a ring body 17 (FIGS. 1 and 5), which has a center opening 18 disposed coaxially with the openings 10, 11, as well as an annular groove 19 for accommodating an O-ring 20 (FIG. 5). The sliding ring 15 and the ring body 17 jointly form a plane of a blocking slide, in which a blocking slide 21 (FIG. 9) formed by a plane and prismatic, molded sheet metal part can be inserted. The plane of the blocking slide on both longitudinal sides of the blocking slide 21 (FIG. 3) is bounded by guide areas (22). Furthermore, as shown in FIGS. 2 and 8, the sliding ring 15 is defined on the bottom side by an outwardly curved surface or by the slanted surfaces 15' and an inclined inner surface 15" of the wall. Said surfaces prevent the blocking slide 21 from impacting the sliding ring 15 in any interfering way as the blocking slide 21 is being pushed into the plane of the blocking slide. The log transmitter 12 supports a collar 23, which is fixed on the log transmitter and preferably supported in the head part 9 in a cover 29 provided with a thread 29', with a sealing ring 29" being mounted in between. An additional ring seal 24 in the cover 29 prevents liquid from spilling over within the head part 9.

If irregularities are noticed during speed measurements with respect to the indicated speed values, the log transmitter 12 needs to be cleaned, as a rule. For this purpose, the cover 29 has to be unscrewed and removed from the head part and pulled out of the sleeve body 4 and the head part 9 in the upward direction together with the log transmitter 12. As said components are being pulled out, the O-rings 12' run against the O-ring 12'", which indicates to the user that the upper end position has been reached. As the log transmitter 12 is being pulled out further, the O-rings 12' cause the O-ring 12'" to widen and to subsequently enter into the widening 12". After the log transmitter 12 has exceeded the plane of the blocking slide, the center openings 10, 11 can be blocked by pushing the blocking slide 21 into the plane of the blocking slide, from the position indicated by the fully drawn line into the position shown by the dashed line (FIG. 1). In said process, the sliding ring 15 rests on the blocking slide 21, exerting pressure onto the latter, and the O-ring 20 of the ring body 17 comes to rest against the underside of the blocking slide 21 at the same time, which effects a watertight blocking of the openings 10, 11 by means of the blocking slide 21, which is kept watertight in this way. After the log transmitter 12 has been cleaned, it has to be pushed again into the openings 10, 11 in the reverse order, whereby the blocking slide 21 has to be moved outwards shortly before the log transmitter has reached the plane of the blocking slide. Thus water is prevented from exiting from the device in either direction of movement of the log transmitter 12 by means of the blocking slide 21. At the same time, the O-ring 12'" moves from the widening 12" in order to come to rest against the log transmitter 12, sealing the latter. Reference numeral 27 denotes a sealing ring to be mounted between the ring body 17 and the threaded ring 9', whereas the reference numeral 28 denotes a spherical element (FIG. 9) that can be used as a handle for the blocking slide 21, and reference numeral 30 denotes threaded screws for fixing the structural components 9' 9, 17 of the head part on each other.

Figure 11:
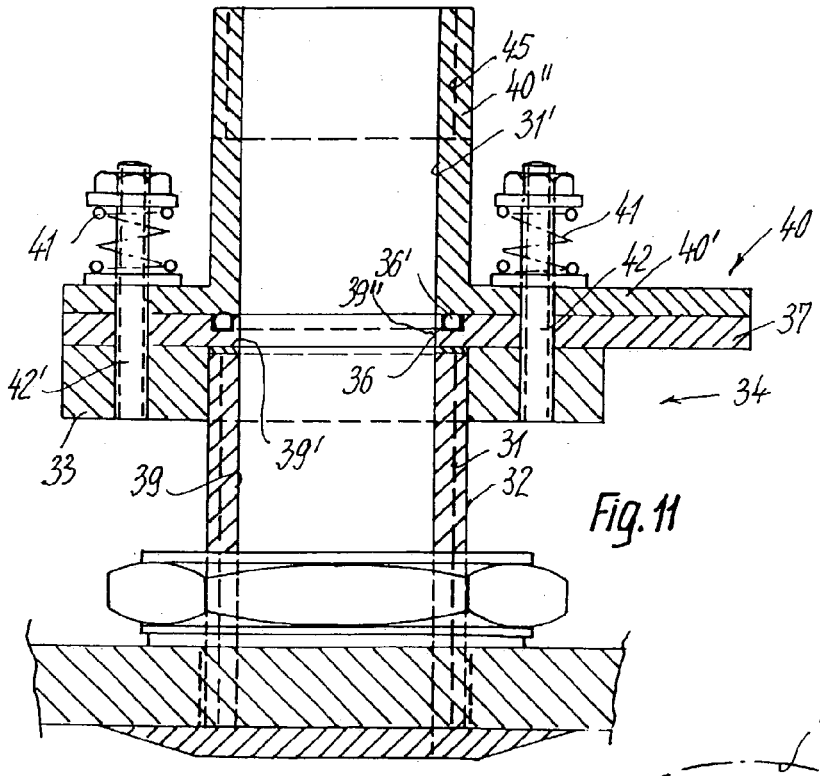
FIG. 11 is a sectional view of a device with an alternative embodiment.
Figure 12:
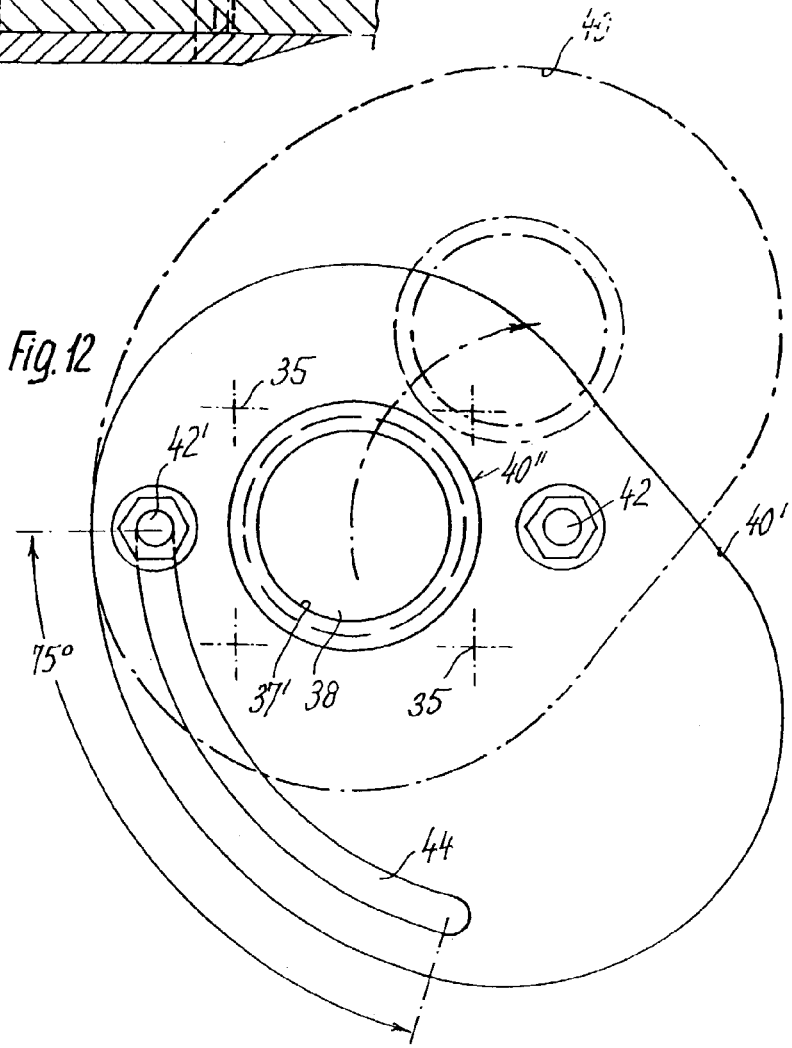
FIG. 12 is a top view of a device according to FIG. 11.

In the device shown in FIGS. 11 and 12, a sleeve body 32 provided with an outer thread 31 and having an oblong opening 39 is fixed on the wall 1 of the hull of the boat by means of a threaded nut 32' and a flange 32". A head part 34 is mounted in a fixed manner on the free end of the sleeve body 32 by means of a threaded ring 33. A sealing ring 39' is arranged between the sleeve body 32 and the head part 34.

Furthermore, at 35, by means of screws not shown, the threaded ring 33 is connected in a fixed manner with a flange 37 provided with an O-ring 36' inserted in an annular groove 36. A blocking element 40 provided with a passage 38 disposed concentrically in relation to the longitudinal opening 39 is supported on the flange 37 under spring force. The spring force is supplied in this connection by two screw springs 41 arranged diagonally in relation to each other and acting on the blocking element 40 from the top; the free abutments of said screw springs are formed by the nuts 43 mounted on the screw bolts 42, 42', the latter being fixed on the head part. The blocking element 40 is capable of swiveling by about 75° about the screw bolt 42 acting as the axle, and is guided in this connection by the other screw bolt 42' that engages a slide groove 44 in the blocking element 40. The flange 37 may be made of any desired material, for example from a suitable plastic or a metallic material, whereby a flange 37 made of metallic material offers the advantage that the blocking element 40 can be beveled within the zone of the edge 37' of the opening, and that the bevel permits adaptation of the O-ring 36' when the blocking element 40 is swiveling. The blocking element 40 is preferably formed by a plate-shaped body part 40' with an adjoining sleeve-shaped attachment 40", whose free end has a thread 45 to which a cover (not shown) can be screwed. The log transmitter (not shown) is capable of supporting itself with rotational mobility on the cover in a watertight manner.

For explaining the function of the device it is necessary to start from the fact that in the positions shown in FIGS. 11 and 12, the blocking element 40 is associated with the passage 38 of the opening 39" of the flange 37 in a coaxial manner. The blocking element 40 is resting here in a pressure-exerting manner on the O-ring 36' owing to the force of the initial tension of the two springs 41 clamped on the screw bolts 42, 42', which prevents water from passing through within the zone of the passage 38 of the blocking element 40. The positions shown for the blocking element 40 and the flange 37 permit a log transmitter to be inserted in the center and longitudinal openings 31' and 39, respectively. As shown in FIG. 12, for inserting the log transmitter, the blocking element 40 has to be turned in the anticlockwise sense of rotation, so that the passage 38 corresponds coaxially with the center opening of the sleeve body 32 (position drawn by a dashed line).

For cleaning work on the log transmitter, the log transmitter present in the longitudinal opening 39 and the center opening 31' has to pulled from the device upwards and then moved in the position shown by the dashed line by swiveling the blocking element 40 down in the clockwise sense, whereby the opening 39" can be closed due to the fact that the plane part of the blocking element extends over the opening 39". It is understood that for reaching the closing position, no water or a minor amount of water at the most flows in the interior of the boat.

For installing the log transmitter in the device, the blocking element 40 is turned in the opposite direction, i.e. in the anticlockwise sense of rotation (FIG. 12), whereby the blocking element 40 is moved from the position shown by the dashed line back into the position indicated by the full line in FIG. 12. Again, no water will penetrate the interior of the boat because when the blocking element is swiveled back, it is retained on the O-ring 36' in a pressed way. The free end of the sleeve-like attachment 40" can be sealed by means of a screw-on type cover (not shown).

The invention claimed is:

1. A device for holding a boat speedometer log transmitter in a boat hull, the device comprising:

a) a sleeve body fixed in a perforation in the boat hull, said sleeve body having a longitudinal center opening for removably inserting and retaining the log transmitter in a watertight manner;

b) a head part coupled in a watertight manner to an upper end of said sleeve body, said head part having a center opening with substantially a same shape and cross-sectional size as said longitudinal center opening and said head part having a recess arranged coaxially with said center opening, wherein said center opening is coupled to said longitudinal center opening in a watertight manner for jointly receiving the log transmitter in a watertight manner; said head part comprising:

i) a sliding ring disposed in said recess and axially displaceable against a spring force;

ii) a plane ring body disposed below said sliding ring; and iii) a first sealing ring supported on said plane ring body; and c) a blocking slide for blocking and opening said longitudinal center opening and said center opening during removal and insertion of the log transmitter, wherein said blocking slide is transversely movable and guided in a plane defined on a top side by said sliding ring and on a bottom side by said first sealing ring to form a watertight seal in a closed position.

2. The device according to claim 1, further comprising a threaded ring fixed on said head part for connecting said head part to said sleeve body in a fixed and detachable manner.

3. The device according to claim 1, wherein said first sealing ring is disposed in an annular groove in said plane ring body.

4. The device according to claim 1, further comprising a second sealing ring disposed on a bottom of said recess adjacent to said sliding ring, wherein said second sealing ring provides said spring force for axially displacing said sliding ring toward said plane ring body and closing said plane of said blocking slide and wherein a movement of said blocking slide provides a force acting transversely to said movement for axially displacing said sliding ring and opening said plane of said blocking slide.

5. The device according to claim 1, wherein said sliding ring comprises an inclined inner surface and an underside having an outwardly arched, curved or inclined surface.

6. The device according to claim 1, wherein a plurality of O-rings are fixed to the log transmitter for supporting the log transmitter in a watertight manner on a wall of said longitudinal center opening and on a wall of said center opening.

7. The device according to claim 6, further comprising a ring-shaped sealing body disposed in a groove formed in said center opening at an upper portion of said head part, said groove enlarged by a radial widening, wherein said ring-shaped sealing body rests against the log transmitter in a Pressure-exerting and sealing manner, said ring-shaped sealing body indicates a position of said log transmitter by contacting at least one of said plurality of O-rings as said log transmitter is displaced upwardly, and said at least one of said plurality of O-rings displace said ring-shaped sealing body into said radial widening as the log transmitter is further displaced upwardly for removal.

8. A device for holding a boat speedometer log transmitter in a boat hull, the device comprising:

a) a sleeve body fixed in a perforation in the boat hull, said sleeve body having a longitudinal center opening for removably inserting and retaining the log transmitter in a watertight manner;

b) a head part coupled in a watertight manner to an upper end of said sleeve body, said head part having a center opening with substantially the same shape and cross-sectional size as said longitudinal center opening, wherein said center opening is coupled to said longitudinal center opening in a watertight manner for jointly receiving the log transmitter in a watertight manner; said head part comprising a flange extending concentrically with said longitudinal center opening and said center opening; and c) a blocking element resting on said flange in a watertight manner for blocking and opening said longitudinal center opening and said center opening during removal and insertion of the log transmitter, said blocking element having a passage therethrough, wherein said blocking element swivels between a first position wherein said passage corresponds concentrically with said longitudinal center opening and said center opening and a second position wherein said blocking element blocks said longitudinal center opening and said center opening.

9. The device according to claim 8, further comprising a threaded ring fixed on said head part for connecting said head part to said sleeve body in a fixed and detachable manner.

10. The device according to claim 8, further comprising a sealing body disposed in a groove in said flange, wherein said blocking element is guided against said sealing body in a pressureexerting and sealing manner by means of an initial spring tension.

11. The device according to claim 10, further comprising a plurality of screw bolts fixed on said head part and a coil spring disposed on at least one of said plurality of screw bolts, wherein said coil spring provides said initial spring tension.

12. The device according to claim 11, wherein said blocking element further comprises a slide groove for receiving and guiding one of said plurality of screw bolts and wherein said blocking element is pivotably-mounted to another of said plurality of screw bolts.

13. The device according to claim 8, wherein said blocking element comprises a plate-shaped molded component with an attachment disposed on a side facing away from said sleeve body.

* * * * *

UNITED STATES PATENT AND TRADEMARK OFFICE

CERTIFICATE OF CORRECTION

PATENT NO. : 7,140,320 B2
APPLICATION NO. : 09/856390
DATED : November 28, 2006
INVENTOR(S) : Bamert It is certified that error appears in the above-identified patent and that said Letters Patent is hereby corrected as shown below:

In particular, on the cover page, column 1, item [30], the Foreign Application Priority data correctly should read: -- October 21, 1999 (DE) …….. 199 50 751.1--.

Signed and Sealed this

Thirteenth Day of February, 2007

JON W. DUDAS
*Director of the United States Patent and Trademark Office*